US005082543A

United States Patent [19]

Gnann et al.

[11] Patent Number: 5,082,543

[45] Date of Patent: Jan. 21, 1992

[54] FILTER PRESS ELECTROLYSIS CELL

[75] Inventors: Michael Gnann, Pfaffenhofen; Erwin Rossberger, Grossdingharting, both of Fed. Rep. of Germany

[73] Assignee: Peroxid-Chemie GmbH, Hollriegelskreuth, Fed. Rep. of Germany

[21] Appl. No.: 605,650

[22] Filed: Oct. 30, 1990

[30] Foreign Application Priority Data

Nov. 16, 1989 [DE] Fed. Rep. of Germany ..... 3938160

[51] Int. Cl.[5] ..... C25B 9/00; C25B 15/08

[52] U.S. Cl. ..... 204/255; 204/257; 204/262; 204/263; 204/269; 204/290 F; 204/290 R; 204/296; 204/283; 204/284

[58] Field of Search ..... 204/241, 262, 255, 257, 204/269, 290 F, 296, 283, 279, 82, 284, 290 R, 263-266, 253-254, 256, 258

[56] References Cited

U.S. PATENT DOCUMENTS 3,915,816 10/1975 Rossberger ..... 204/82
4,626,327 12/1986 McCarthy ..... 204/82
4,802,959 2/1989 Lipsztajn ..... 204/82
4,828,660 5/1989 Clark et al. ..... 204/82
4,995,550 2/1991 Appl et al. ..... 228/175

*Primary Examiner*—Donald R. Valentine

[57] ABSTRACT

The present invention provides an electrolysis cell of the filter press type for the production of peroxy and perhalogenate compounds comprising alternatingly arranged cathodes and anodes provided with electrolyte feeds, wherein the cathodes (1) and anodes (2) consist of right parallelpiped-shaped hollow bodies between which are present frame-shaped seals (3) and which, via these seals (3), are connected together in a liquid-tight manner and insulated from one another to give a cell pile, the cathode hollow bodies (1) are liquid- and gas-permeable, the anode hollow bodies (2) possess, above and below a platinum layer, openings for the introduction and removal of the anolyte and the effective anode surface is formed by the platinum metal layer of a composite anode comprising a valve metal substrate and a platinum layer present thereon which is obtainable by the hot isostatic pressing of a platinum foil on to a valve metal carrier.

14 Claims, 6 Drawing Sheets

FILTER PRESS ELECTROLYSIS CELL

The present invention is concerned with an electrolysis cell for the anodic production of peroxy compounds, for example peroxydisulphates, peroxymonosulphates and peroxydiphosphates, as well as of the corresponding acids; and of perhalogenates and the corresponding acids, especially of perchlorates and perchloric acid.

Figure 1:
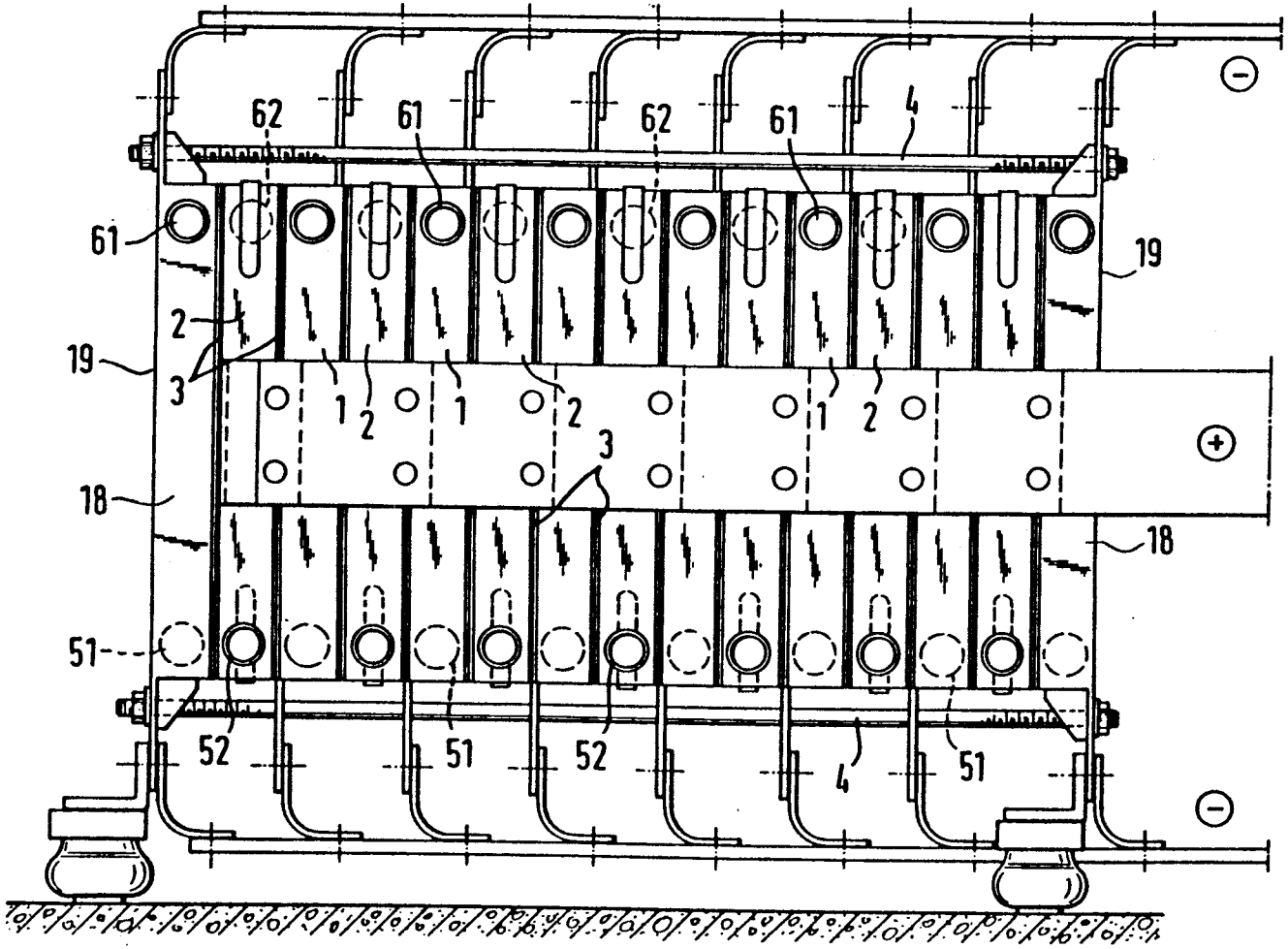
FIG. 1 is a schematic front view of an electrolysis cell according to the present invention.

Membrane electrolysis cells, mostly of the filter press type, have, for some years, achieved increasing technical importance in the industrial production of chlorine and aqueous sodium hydroxide solution. However, the numerous cell constructions described in technical journals and patent literature are not suitable for the production of, for example, peroxydisulphates and peroxydisulphuric acid since the anode material used in chlor-alkali electrolysis cells, mostly based on titanium support/mixed oxides of metals of Group VIII of the Periodic Table and titanium, is technically not suitable for the formation of peroxydisulphates because the current yield and durability thereof are too low. Admittedly, the current yield can be increased to technically interesting values when using iridium-containing mixed oxides but only when using fluoride-containing anolyte additives which, however, soon destroy the coating and thus make the anodes unusable (cf. Fukuda et al., Electrochimica Acta, 24, 363–365/1979).

Endeavours to develop membrane cells for the electrolytic production of peroxy and perhalogenate compounds have hitherto still not given a technically usable solution to the problem. An important reason for this is the lack of anode materials which are stable for a long time and composite electrodes made therefrom which, in the form of sheets, can be worked up in an economic manner for the construction of electrodes and cells. Such composite electrodes should consist, for example, of a titanium or tantalum substrate which is connected homogeneously, laminarly and adherently with a platinum foil layer. For the production of peroxo compounds, it is still necessary to employ massive platinum as the sole technically usable anode material. Composite electrodes in which a platinum layer has been produced by cathodic deposition from galvanic platinum baths or platinum salt melts have an insufficient adherent strength, an insufficient life and an unsatisfactory current yield.

In the case of the production of the previously usual anodes, it was necessary to fix the platinum metal in the form of wires, strips or foils on to the metal substrates titanium or tantalum which are resistant towards the electrolyte by locally limited and thus non-laminar connections, for example by spot or roll seam welding or by means of mechanical pressingon devices. These contact points formed by welding or mechanically are not liquid-tight and are thus accessible to the electrolyte. According to experience, in the course of time they are destroyed by corrosion and arcing over, whereafter the platinum parts lift off from the substrate wholly or partly and are lost for the electrolysis process. Therefore, the degree of utilisation for the platinum metal invested in an electrolysis plant is limited. It does not reach by far the calculated value which is obtained by calculating the quotient "installed weight of platinum/-specific platinum consumption per tonne of product". With a homogeneous, firmly adhering platinum layer of 50 μm. thickness, for example in the case of an anodic current density of 9 $kA/m^2$, there could be achieved a running time of 15 to 20 years in the case of the electrolytic production of potassium peroxydisulphate but in technical operation with platinum foils mechanically pressed on to a titanium tube as anode support, a maximum period of life of only about 3 years is achieved. A composite anode which has partly mechanically lost the platinum foil has to be provided with a new layer or has to be replaced by a new anode.

Electrolysis cells which are constructed with the use of partially contacted composite electrodes are known (cf. J. Balej and H. Vogt, "Electrochemical Reactors", Fortschritte Verfahrenstechnik, 22, 371–389/ 1984). Electrolysis cells for the production of peroxydisulphuric acid require a separator which separates the cathode chamber from the anodically-produced peroxydisulphate in order that reduction thereof on the cathode surface is reduced or prevented. Various constructions use, as anode, platinum foil strips which are fixed on to tantalum sheets by roll seam welding (thus only locally). In other electrolysis cells, platinum wire is used which is either fixed on flat titanium wire meshes by spot welding or is wound spirally around a silver wire coated with tantalum and fixed thereon, for example by spot welding. In the case of these cell constructions, an anodic current density of 5 $kA/m^2$, referred to the platinum surface, cannot be exceeded since otherwise the current load of the contacting points between the support and the platinum becomes too high, which would then lead to the destruction thereof by heating and corrosion. Cells for the production of salts of peroxydisulphuric acid are similarly constructed. However, constructions without a separator or diaphragm can thereby also be used when the peroxydisulphate is precipitated as salt during the electrolysis and the electrolyte flows through the cell sufficiently quickly.

Also for the production of perhalogenates, especially for the production of perchloric acid and of the salts thereof, use is made of tantalum or titanium anodes covered with platinum foil. In comparison with lead dioxide-coated graphite anodes, these provide advantages with regard to the period of life and the yields obtained. Platinum-coated titanium has hitherto not proved technically useful for the production of perchlorates. For similar reasons as in the case of the hitherto used anodes for the production of peroxydisulphates, also in the case of the production of perchloric acid and of perchlorates, the anodic current density of 5 $kA/m^2$ used cannot be exceeded.

Therefore, it is an object of the present invention to provide an electrolysis cell for the production of peroxy and perhalogenate compounds with which a period of life corresponding to the platinum content of the composite anode can be achieved and which makes possible a high current density and a low energy consumption.

Thus, according to the present invention, there is provided an electrolysis cell of the filter press type for the production of peroxy and perhalogenate compounds comprising alternatingly arranged cathodes and anodes provided with electrolyte feeds wherein the cathodes and anodes consist of right-parallelepiped-shaped hollow bodies between which are present frame-shaped seals and which, via these seals, are connected together in a liquid-tight manner and insulated from one another to give a cell pile, the cathode hollow bodies are liquid- and gas-permeable, and anode hollow bodies have, above and below a platinum layer, openings for the introduction and removal of the anolyte and the effective anode surface is formed by the platinum layer of a composite anode comprising a valve metal substrate and a platinum layer present thereon which is obtainable by the hot isostatic pressing (HIP) of a platinum foil on to a valve metal carrier.

Preferably, the platinum foil possesses a thickness of 20 to 100 μm. and especially of 50 μm.

As valve metal, there is preferably used tantalum or niobium and especially titanium. The thickness of the valve metal carrier (valve metal sheet) is preferably so chosen that it can easily be worked up to give electrodes and can be stably incorporated into appropriate cell constructions; preferably, the valve metal carrier has a thickness of 1 to 6 mm., especially of 2 to 4 mm. and particularly of 3 mm.

The welding of the composite sheet produced by hot isostatic pressing (HIP; diffusion welding) can take place with the use of per se known welding techniques appropriate therefor, for example by TIG welding, or by the use of a laser technique. The welding zone must be absolutely free from platinum because otherwise alloys result which are not corrosion-resistant.

Preferred embodiments of this electrolyte cell are, usable individually or in combination, set out in the following: The platinum foil has a thickness of 20 to 100 μm. The valve metal is titanium, niobium or tantalum. The valve metal carrier has a thickness of 1 to 6 mm. Between the cathode hollow bodies and the anode hollow bodies are present separators, by means of which the catholyte chambers are separated from the anolyte chambers. The separator preferably consists of a fluoreinated, sulphonic acid group-containing cation exchange membrane. It lies on the perforated, liquidand gas-permeable cathode surface and is positioned at a distance of 0.5 to 5 mm. from the platinum anode surface. The effective cathode parts (12) of the cathode hollow body (1) are made perforated. They are preferably roughened and/or provided with a coating for reducing the cathode polarisation. The openings above and below the platinum layer for the introduction and removal of the anolyte are either slit-shaped openings or are formed by a plurality of bores lying next to one another. The width of the slit-shaped openings or the diameter of the bores becomes larger from the electrolyte introduction and removal side (52, 62) towards the opposite side. The anode hollow bodies are provided with inlets and outlets for a cooling agent (71, 72) and comprise three chambers, the upper and lower of which serve for conducting the electrolyte and the middle one of which serves for cooling the rear side of the active anode surfaces. The sealing material for the frame-shaped sealings (3) is preferably a vinylidene fluoride-hexafluoropropylene co-polymer.

The present invention is also concerned with the use of an electrolysis cell according to the present invention for the electrolytic production of peroxy and perhalogenate compounds.

The electrolysis cell according to the present invention is made from quadrate-shaped, rectangular hollow bodies for cathodes and anodes which are insulated from one another by frame-shaped seals and connected liquid-tight with one another, for example are screwed together. Above and below the rectangular platinum layer, the anode hollow body possesses, respectively, an opening for the introduction and removal of the anolyte, preferably a slit-shaped opening or a number of bores.

Separators are preferably present between the anode and cathode bodies, the separators preferably being clamped between the frame-shaped seals. For the production of the peroxy compounds, it is preferable to use a separator made of a fluorinated, sulphonic acid group-containing cation exchange membrane (CIA membrane), for example a cation exchange membrane of the type NAFION ® 423 (semipermeable membrane based on poly-(perfluoroalkylene)-sulphonic acid).

The separator preferably lies on the perforated, liquid- and gas-permeable cathode surface and the distance of the separator from the smooth, flat platinum anode surface (platinum layer of the composite anode) is preferably 0.5 to 5 mm.

In the case of the use of a cation exchange membrane, for example of the type NAFION ®423, we have, surprisingly, ascertained that this can not only be used up to about 5 kA/m$^2$ (in chlor-alkali electrolysis, with the use of membrane cells in continuous operation, there are achieved at most 3 to 5 kA/m$^2$). Also longterm loading of up to 15 kA/m$^2$ has no influence on the function and stability of the cation exchange membrane. This is of great importance because a technical electrolysis plant for the production of peroxy or perhalogenate compounds can be operated considerably above the nominal capacity when the electrolysis cell is suitable for overloading. In the case of the use of the electrolysis cell according to the present invention, this effect is useful and it permits the removal of the ohmic heat production caused by excessive capacity consumption.

The effective cathode parts in the cathode hollow bodies preferably consists of a metal sheet, for example expanded metal, perforated metal sheet or slatted plates, provided with openings.

The composite anodes are used in the cells according to the present invention with a smooth, continuous platinum surface and thus not, for example, as expanded metal. The electrolysis cell is preferably operated with a hydrostatic overpressure in the anode chamber of more than 0.02 bar (2000 Pa) with regard to the cathode chamber. This suffices in order to press the cation exchange membrane against the cathode consisting of perforated material and thus to provide the necessary distance between the anode surface and the CIA membrane. In order to keep the cell voltage low, this distance should preferably not exceed 5 mm. and especially 3 mm. In the case of the maintenance of appropriately chosen electrolysis conditions, with the arrangement according to the present invention, anodic product-current yields of 92 to 96% can be achieved; therefore, the amount of gaseous oxygen formed anodically as a by-product is so low that, even in the case of a distance of 0.5 mm. between the anode and the separator, no disturbing gas bubble effects occur. Flow rates of >0.3 m./sec. should thereby preferably be maintained. Since the cathode material is perforated and is preferably made of expanded metal, the electrolytically produced hydrogen can easily escape "towards the back".

In a further preferred embodiment of the cathode, the surface of the cathode is provided with a fine-structured roughening by mechanical and/or chemical measures, for example by sand blasting and/or etching in acids. The surface enlargement thereby brought about results in a reduction of the cathode polarisation (hydrogen overvoltage), corresponding to a reduction of the effective cathodic current density, the cell voltage thereby being reduced to the same extent. A strengthening of this depolarisation effect can be achieved by coating of effective cathode surfaces with metals and/or oxides of Group VIII of the Periodic Table of Elements, this covering being advantageously produced with a large surfaced microstructure. The cathode material is preferably stainless steel.

The openings for the introduction and removal of the anolyte present in the anode hollow bodies above and below the preferably rectangular platinum layer are preferably slit-shaped openings or are formed by a plurality of bores lying next to one another in rows. Preferably, the width of the slit-shaped openings or the diameter of the bores becomes larger from the electrolyte introduction or removal side towards the opposite side.

The anode hollow bodies are preferably so constructed that the rear side of the active anode surfaces can be cooled. For this purpose, they can be provided with, for example, inlets and outlets for a cooling agent and especially for cooling water.

In a preferred embodiment, the anode hollow bodies are so constructed that they consist of three chambers, the upper and lower of which serve for conducting the electrolyte and the middle one of which serves for the cooling of the rear side of the active anode surfaces.

In the accompanying drawings, there are illustrated preferred embodiments of electrolysis cells according to the present invention.

Figure 2:
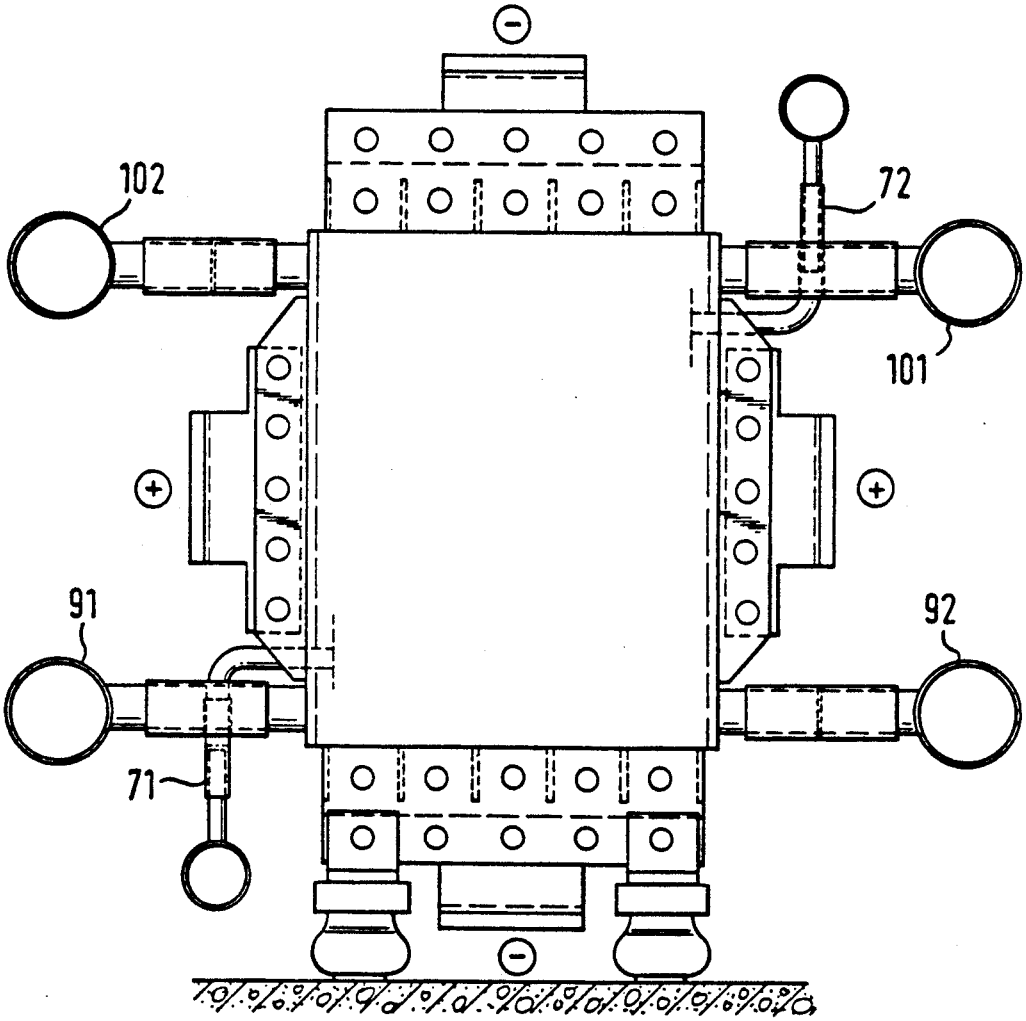
FIG. 2 is a schematic end view of the electrolysis cell illustrated in FIG. 1.

FIGS. 1 and 2 show schematically the construction of an electrolysis cell according to the present invention:

The electrolysis cell consists essentially of two end cathodes 18 of identical construction (mirror-image symmetrical), of a plurality of quadrate-shaped, rectangular hollow bodies for cathodes 1 and anodes 2 and of seals 3 which are pressed liquid-tightly between the alternatingly arranged anodes and cathodes by means of threaded rods 4 and insulate from one another the electrodes of opposite polarity. Separators (not shown) are possibly present which separate from one another the differently composed electrolytes of the cathode and anode chambers. As separators, it is preferable to use those known for chlor-alkali electrolysis and especially cation exchange membranes of the type NAFION ®423 (semi-permeable membranes based on poly-(perfluoroalkylene)-sulphonic acid). The separators lie between the seal 3 and the frame of the cathode 1 in such a manner that an electrolyte escape (a "wicking" of the cation exchange membrane outwardly) by an overhanging edge of the seal is dependably prevented .

Each of the right parallelepiped-shaped, cathode and anode hollow bodies possesses pipe connections 51, 61, 52, 62 for the introduction 51, 52 and removal 61, 62, respectively, of catholyte and anolyte, respectively (in each case in diametric position 51/61 and 52/62, respectively). These pipe connections, which are arranged alternatingly with the polarity, are flexibly connected with the inlet 91, 92 and outlet distribution pipes 101, 102 of the cell pile. In addition, the anode hollow bodies have pipe connections for the inlet 71 and outlet 72 of cooling water.

The cooling of the anode hollow bodies makes possible an electrolysis operation with current densities of up to 15 $kA/m^2$ and more because it prevents with certainty the heating of the anode surface brought about by ohmic voltage losses and thus guarantees a high product yield and a low oxygen generation.

This anode cooling also has an especially favourable effect in the case of the synthesis of peroxydisulphuric acid and of perchloric acid where especially low temperatures are to be maintained.

On both sides or on one side, the anode hollow bodies 2 possess connection lugs for the current supply (positive polarity) which takes place by means of flexible copper angle pieces from copper current supply bars. In analogous manner, the cathode hollow bodies 1 are connected with the negative pole of a rectifier, the current connection thereby taking place above and/or below the cathodes.

Figure 3:
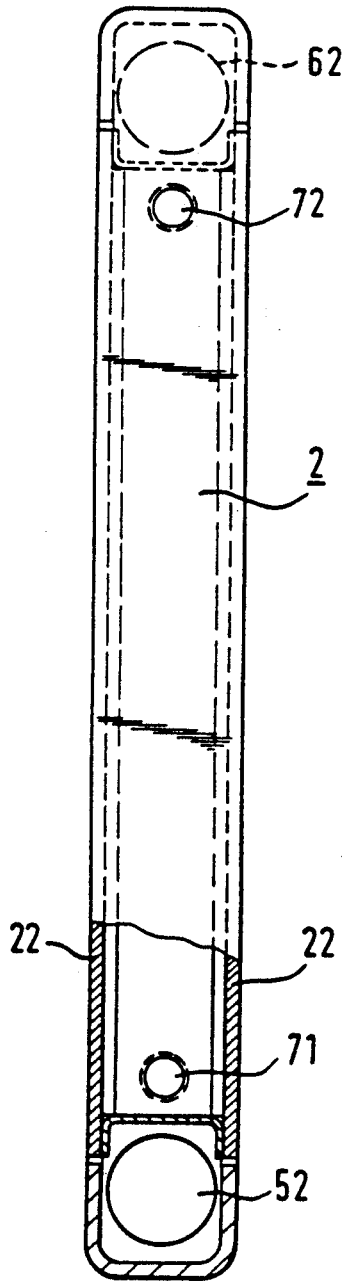
FIG. 3 is a cross section of the anode hollow body which forms a part of the electrolysis cell illustrated in FIG. 1.
Figure 4:
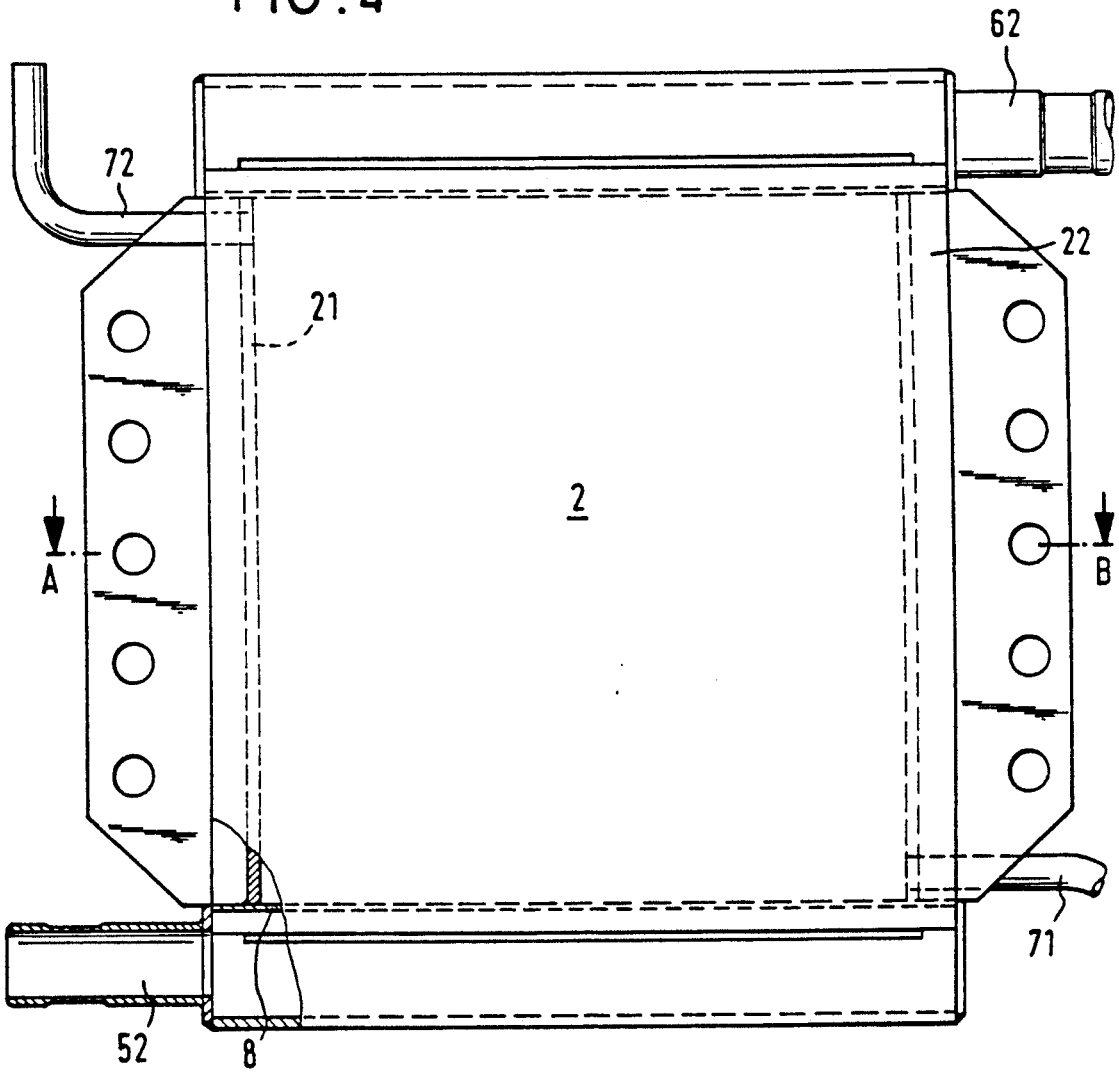
FIG. 4 is a plan view of the anode hollow body illustrated in FIG. 3.
Figure 5:
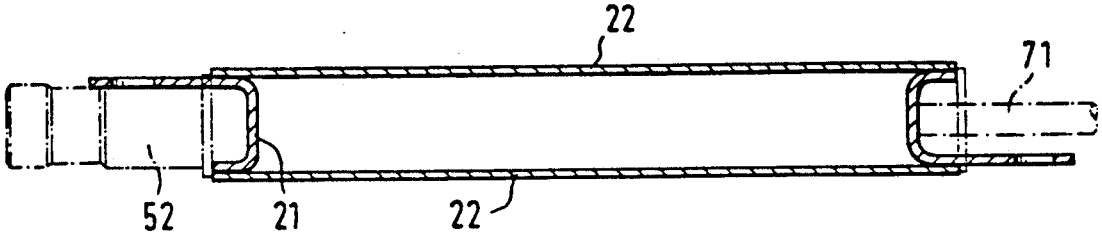
FIG. 5 is a cross section of the anode hollow body illustrated in FIG. 4 taken along the plane A-B.

FIGS. 3 to 5 show embodiments for the construction of the anode hollow body 2 described in FIGS. 1 and 2 in cross-section (FIG. 3), in plan view (FIG. 4) and in the section of the plane A–B of FIG. 4 (FIG. 5).

The flat, quadrate-shaped anode hollow body includes two opposite-lying anode base surfaces from the actual anode parts 22 covered with platinum foil, side boundaries 21 and diametrically arranged cooling agent connections 71, 72. Electrolyte introductions and removals are provided below and above the anode parts 22/21/22/21 with, in each case, a pipe connection 52, 62 and a closure plate 8. The pipe connections are positioned on the anode hollow body lying diametrically opposite.

The electrolyte supply parts of the anode are so welded to the anode hollow bodies that, in each case, between the anode part 22 and the closure plate 8, there is present a slit or a row of bores for the inflow and outflow of the anolyte.

The anode support body (anode substrate) is made from a so-called valve metal and preferably of titanium. The welding of the composite metal sheet produced by hot isostatic pressing, for example a platinum foil of 50 μm. thickness on a 3 mm. thick titanium sheet, can take place with the help of welding techniques appropriate therefor, for example TIG welding, or by means of a laser technique. The welding zone must be absolutely free from platinum because otherwise alloys result which are not corrosion-resistant. After the welding procedure, the anode hollow body is converted on its edges which are contacted with the frame seal 3 (cf. FIG. 1), possibly by mechanical post-working, into a fully planar state.

In its interior, the anode part 22/21/22/21 can contain elements for increasing the Reynolds number, for example flow baffles (not shown). The electrolyte supply parts of the anode body can also be provided with inserts for the equalisation of the flow.

Figure 6:
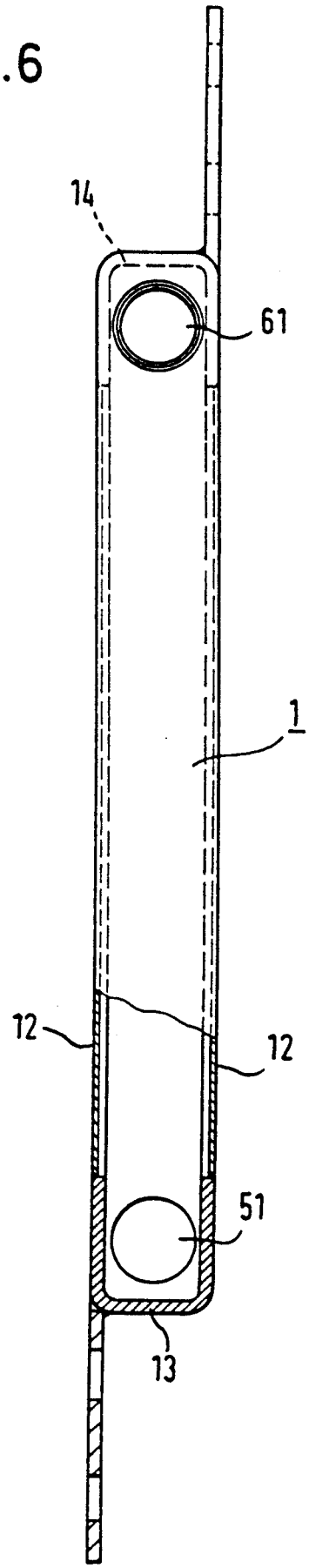
FIG. 6 is a cross section of the cathode hollow body which forms a part of the electrolysis cell illustrated in FIG. 1.
Figure 7:
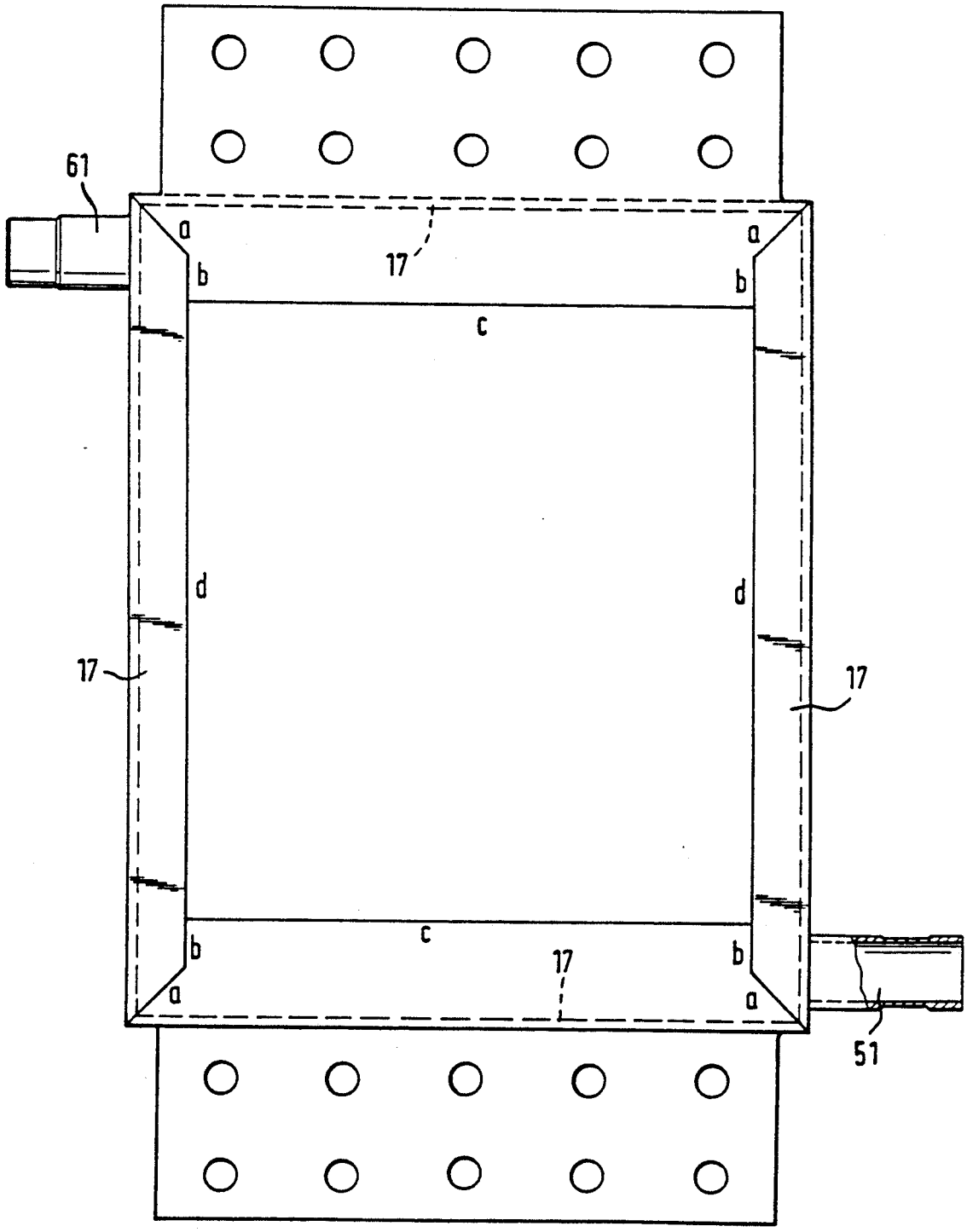
FIG. 7 is a plan view of the cathode hollow body illustrated in FIG. 6.

FIGS. 6 and 7 show embodiments for the construction of a cathode hollow body according to FIG. 1 in section (FIG. 6) and in plan view (FIG.7).

The flat, right parallelepiped-shaped cathode hollow body 1 comprises the electrochemically-effective cathode parts 12, which are welded on the lateral edges with U-profiles 13 and 14. The cathode parts 12 can be made, for example, as expanded metal, perforated metal sheet or as shutter plates. In the case of a cell without separator, the cathode can also be equipped with metal sheets (instead of with expanded metal), in which case the cathode is then constructed like the anode and thus can also be cooled. The electrolyte inlet 51 and outlet pipes 61 are present below and above the cathode parts 12. The pipe connections are positioned on the cathode hollow body diametrically opposite.

Both cathode parts are welded together along the line a-b-c-d, the outwardly closed cathode hollow body thereby being formed. It can contain inserts (not shown) for the equalisation of the electrolyte flow and of the current distribution.

As material for the cathode body, there is preferably used stainless steel. For the production of peroxy and perhalogenate compounds, stainless steel of tool steel No. 1.4539 has thereby proved to be especially useful. The welding of the stainless steel parts takes place with the use of per se known welding techniques appropriate therefor. After the welding procedure, the cathode body is converted into a completely planar state on its edges 17 which are contacted with the edge seal and possibly with the separator, possibly by mechanical after-working.

For the achievement of a low cathode polarisation, as a rule, a roughening of the cathode plates 12 can be carried out. This can take place on the finished cathode body, for example, after covering the sealing edges 17, by means of sand blasting and/or by means of an etching paste. For the further strengthening of the depolarisation effect, the cathode plates can be coated by per se known processes, for example with Raney nickel (for example by flame or plasma spraying) or thermally with mixed oxides of, on the one hand, titanium, tantalum and/or zirconium and, on the other hand, platinum, ruthenium and/or iridium. If necessary, for example, in the case of Raney layers, extractable components, for example aluminium or magnesium, are removed by means of alkaline or acidic solutions.

The "end cathodes" 18 of the electrolysis cell consist of hollow bodies closed on one side; the side facing the cell interior consists either of a perforated and thus liquid- and gas-permeable metal sheet or of a smooth metal sheet leaving free slits or bores on the lower edge, whereas the opposite-lying side consists of a massive metal plate 19 and forms the cell wall (cf. FIG. 1).

The electrolysis cell consists of n anodes and n+1 cathodes. A (double) anode constructed according to the present invention of two 0.06 $m^2$ platinum surfaces takes up 0.6 kA of current per anode in the case of the maximum current densities of 5 $kA/m^2$ hitherto used in the technology. However, the electrolysis cell according to the present invention can be operated with 1 kA as continuous loading and with 1.8 kA as peak loading. The current densities usual according to the previous technique for the production of peroxy compounds in divided cells (with separators) can be considerably exceeded in the electrolysis cells according to the present invention. A correspondingly equipped electrolysis plant is able, therefore, to take peak current, for example night current, from current supplies relatively quickly and flexibly; on the other hand, it can be operated down to 2 $kA/m^2$ without sacrifice of the minimum load.

Because of its compact manner of construction, the electrolysis cell according to the present invention has only a small spatial requirement (position place requirement). Thus, for example, for an electrolysis cell for the production of ammonium peroxydisulphate (APS) operated with 8.33 $kA/m^2$ for 7 kA nominal current consumption, corresponding to a production of about 28 kg./h. APS, only a positional area of $0.7\times0.7$ $m^2$ with a constructional height of about 1 m. is necessary. The previously usual cells required a multiple of this space.

In the case of appropriate choice of the sealing material between the electrode hollow bodies, there can be achieved cell lives of at least 5 years; in comparison with the cells at present used, the servicing expense is thereby considerably reduced. Appropriate seals are, for example, seals made of Viton ®(heat- and chemical-resistant vulcanisable fluorine elastomer based on vinylidene fluoride-hexafluoropropylene copolymers). In the case of these seals, the compression on the outer sides by round or rectangular parts of materials resistant towards the electrolytes is limited (for example, ceramic, polyvinylidene fluoride and IT seals). In this way, a definite distance of the cell segments and a definite sealing compression can be adjusted.

The electrolysis cells according to the present invention can also be operated without separators, for example for the production of potassium or sodium peroxydisulphate with simultaneous precipitating out of the salts and for the production of sodium perchlorate, with the addition of sodium dichromate as cathodic covering layer former.

The following Examples are given for the purpose of illustrating the present invention.

EXAMPLE 1

An electrolysis cell according to the present invention was constructed from 7 anodes, which were coated on both sides by hot isostatic pressing (HIP) with, in each case, 0.06 $m^2$ ($0.255\times0.235$) platinum foil of 50 μm. thickness on a 3 mm. thick titanium sheet, and 8 cathode bodies, the active cathode surfaces of which consisted of expanded metal of the mesh width $12.7\times6$ mm. and web width 2 mm. It was provided with CIA membrane NAFION ®423 of 330 μm. thickness (supporting fabric PTFE) which lay on the cathode and, with the help of an IT-supported VITON ® seal, was adjusted to a distance of 2.5 mm. to the anode surface.

The cathode surfaces had been so treated by sand blasting and chemical etching in dilute sulphuric acid (1:1) that there was obtained a surface roughness of average degree (grey colour).

The anolyte consisted of 0.2M sulphuric acid, 2.6 M ammonium sulphate and 0.9 M ammonium peroxydisulphate and an addition of ammonium thiocyanate (4.5 g./kg. of ammonium peroxydisulphate at 40° C.). As catholyte, there was used a solution of 1 M sulphuric acid and 3.5 M ammonium sulphate.

In the case of a current take-up of 7 kA, corresponding to an anodic current density of 8.33 $kA/m^2$, there was produced ammonium peroxydisulphate with 92 to 96% current yield with a residence time of the anolyte in the electrode gap of 0.35 seconds, adjusted with the help of a circulation pump. In the course of 40 hours, there was obtained 1.120 kg. of product (dried, chemically pure) by crystallising out, centrifuging, washing and drying. The voltage of the electrolysis cell thereby remained in the range of 6.4 to 6.6 volts. From this is given an energy requirement of 1.6 kWh/kg. of product.

EXAMPLE 2

In an electrolysis cell according to Example 1, 5 M sulphuric acid was used as anolyte. With current densities of 10 kA/m$^2$, corresponding to a current take-up of 9.4 kA, at 8° C. there was obtained peroxydisulphuric acid with a current yield of 88%, for the maintenance of which the dosing in of ammonium thiocyanate was necessary.

EXAMPLE 3

For the production of potassium peroxydisulphate, the electrolysis cell according to Example 1 was advantageously used without cation exchange membrane under the following conditions:

electrolyte: 2.1 M sulphuric acid, 1.4 M potassium sulphate, 0.3 M potassium peroxydisulphate; 1.5 g. ammonium thiocyanate/kg. of potassium peroxydisulphate produced;

current density 9 kA/m$^2$, corresponding to 7.56 kA cell current strength;

temperature: 25° C.

At a cell voltage of 5.9 volts, potassium peroxydisulphate precipitated out from the electrolyte (suspension electrolyte) with a current yield of 75% and was removed from the electrolyte by means of the usual separation and purification steps. Energy requirement: 1.56 kWh/kg.

EXAMPLE 4

In an electrolysis cell according to Example 3, there was electrolysed at 8 kA/m$^2$ a solution of 3.0 M sulphuric acid, 2.8 M sodium sulphate and 0.2 M sodium peroxydisulphate, with the addition of 12 g. sodium thiocyanate per kg. of sodium peroxydisulphate produced. Temperature: 25° C. The residence time of the electrolytes in the electrode gap did not exceed 0.4 seconds. In the case of keeping constant the electrolyte composition, sodium peroxydisulphate (NPS) precipitated out from the suspension electrolyte with 62% current yield. With a voltage of 6.2 volts, there was given an energy requirement of 2.25 kWh/kg.

EXAMPLE 5

In an electrolysis cell according to Example 3, from sodium chlorate solution there was produced sodium perchlorate, the following conditions thereby being maintained:

initial values: 4 to 6 M sodium chlorate, 0.5 to 1 M sodium perchlorate;

end value: 0.3 to 0.5 M sodium chlorate, 7 to 9 M sodium perchlorate;

in the electrolytes, for the purpose of the formation of a cathodic covering layer, there was maintained a concentration of 2 to 5 g./l. sodium dichromate; current density: 5 kA/m$^2$ (up to 15 kA/m$^2$ peak loading); current take-up: 6 kA; current yield: 95% cell voltage: 4.6 volts; energy consumption about 2600 kWh/t;

temperature: 35° C.; pH=4.4 to 5.3.

With the use of a cation exchange membrane, the cells according to the present invention can also be used for the production of perchloric acid by the process according to Federal Republic of Germany Patent Specification No. 10 31 288.

In all electrolyses operated with the use of a cation exchange membrane, on the cathode is formed pure hydrogen which, after passing through a wash system, can be further used directly for chemical or thermal purposes.

What is claimed is:

1. Electrolysis cell of the filter press type for the production of peroxy and perhalogenate compounds comprising alternatingly arranged cathodes and anodes provided with electrolyte feeds, wherein the cathodes (1) and anodes (2) consist of right parallelepiped-shaped hollow bodies between which are present frame-shaped seals (3) and which, via these seals (3), are connected together in a liquid-tight manner and insulated from one another to give a cell pile, the cathode hollow bodies (1) are liquid- and gas-permeable, the anode hollow bodies (2) possess, above and below a platinum layer, openings for the introduction and removal of the anolyte and the effective anode surface is formed by the platinum metal layer of a composite anode comprising a valve metal substrate and a platinum layer present thereon which is obtainable by the hot isostatic pressing of a platinum foil on to a valve metal carrier.

2. Electrolysis cell according to claim 1, wherein the platinum foil has a thickness of 20 to 100 μm.

3. Electrolysis cell according to claim 1, wherein the valve metal is tantalum, niobium or titanium.

4. Electrolysis cell according to claim 1, wherein the valve metal carrier has a thickness of 1 to 6 mm.

5. Electrolysis cell according to claim 1, wherein, between the cathode hollow bodies (1) and the anode hollow bodies (2), are present separators by means of which the catholyte chambers are separated from the anolyte chambers.

6. Electrolysis cell according to claim 5, wherein the separator consists of a fluorinated, sulphonic acid group-containing cation exchange membrane.

7. Electrolysis cell according to claim 5, wherein the separator lies on the perforated, liquidand gas-permeable cathode surface.

8. Electrolysis cell according to claim 5 wherein the separator is installed at a distance of 0.5 to 5 mm. from the platinum surface.

9. Electrolysis cell according to claim 1, wherein the effective cathode parts (12) of the cathode hollow body (1) are perforated.

10. Electrolysis cell according to claim 1, wherein the effective cathode parts (12) are roughened and/or provided with a coating which reduces the cathode polarisation.

11. Electrolysis cell according to claim 1, wherein the openings for the introduction and removal of the anolyte present above and below the platinum layer are slit-shaped openings or are formed by a plurality of bores lying next to one another.

12. Electrolysis cell according to claim 11, wherein the width of the slit-shaped openings or the diameter of the bores becomes larger from the electrolyte introduction side (52) towards the opposite side.

13. Electrolysis cell according to claim 1 wherein the anode hollow bodies are provided with inlets and outlets for a cooling agent (71, 72), said anode hollow bodies comprising three chambers, the upper and lower of which serve for conducting the electrolyte and the middle one of which serves for cooling the rear side of the active anode surface.

14. Electrolysis cell according to claim 1, wherein the sealing material for the frame-shaped sealings (3) is a vinylidene fluoride-hexafluoropropylene co-polymer.

* * * * *